United States Patent [19]

Webster

[11] 4,166,573

[45] Sep. 4, 1979

[54] CENTRIFUGE TUBE ENCLOSURE

[75] Inventor: Donald A. Webster, Fairfield, Conn.

[73] Assignee: E. I. Du Pont de Nemours and Company, Wilmington, Del.

[21] Appl. No.: 856,234

[22] Filed: Dec. 1, 1977

[51] Int. Cl.[2] ..... B04B 5/02

[52] U.S. Cl. ..... 233/26; 233/1 A; 210/DIG. 23

[58] Field of Search ..... 233/26, 27, 28, 1 R, 233/1 A; 210/DIG. 23, DIG. 24

[56] References Cited

U.S. PATENT DOCUMENTS

| | | | |
|---|---|---|---|
| 3,434,615 | 3/1969 | Barletta | 233/26 X |
| 3,720,502 | 3/1973 | Gropper et al. | 233/26 X |
| 3,938,735 | 2/1976 | Wright et al. | 233/26 |
| 3,998,383 | 12/1976 | Ronanauskas | 233/26 |
| 4,076,170 | 2/1978 | Chulay et al. | 233/26 |

*Primary Examiner*—George H. Krizmanich

[57] ABSTRACT

A vertically oriented flexible centrifuge tube is placed in a rotor cavity or other enclosure, and the open end sealed with a tapered plug. The plug is formed with a peripheral groove in the tapered portion. A retaining disc, secured to the open end of the enclosure, wedges the plug into the open end of the flexible tube. The mouth of the enclosure is flared to accommodate the plug's taper. When the tube is centrifuged, the wall of the tube cold flows into the groove forming a locking seam such that the tube and plug are mechanically locked together and maintain an effective pressure seal.

8 Claims, 4 Drawing Figures

CENTRIFUGE TUBE ENCLOSURE

CROSS-REFERENCE TO RELATED APPLICATIONS

The subject invention is an improvement over the centrifuge tube enclosures described and claimed in U.S. Pat. Nos. 3,998,542 issued to Romanauskas et. al. and pending application Ser. No. 751,382 filed Dec. 26, 1976.

BACKGROUND OF THE INVENTION

This invention relates to an apparatus for sealing centrifuge tubes and, more particularly, to an apparatus for sealing centrifuge tubes mounted in rotor cavities.

There is described in the said Romanauskas et. al. patent a seal for a vertically oriented centrifuge tube. Vertically oriented tubes are particularly useful in density gradient separations in which a density gradient in the tube is reoriented from vertical to horizontal during centrifugation and back to vertical for fractionation.

Centrifuge tube caps used prior to those devised by Romanauskas typically were constructed of three parts and were not satisfactory for use with vertically oriented tubes. The parts were not only difficult to assemble and use but also if one wishes to obtain the requisite sealing, a vise was required to hold the closure while being tightened.

The tube cap described by Romanauskas is one in which a tapered plug is introduced into a centrifuge tube disposed in a rotor cavity having a flared mouth. The plug is forced down by a threaded disc which bears axially against the plug so as to wedge the wall of the tube between the plug and the flared mouth of the rotor cavity. Because of the flexibility or resiliency of the tube, a relatively strong, leak proof seal is provided that is effective even under the large pressure forces which occur during centrifugation using vertically oriented tubes. While these seals perform quite satisfactorily, as the diameter of the tubes increase, leakage can sometimes occur, particularly with larger diameter tubes, i.e., those exceeding two centimeters and more. The leakage problem increases as a function of the diameter of the tube, rotor speed and attitude of the tube, i.e., as the tube approaches the vertical or is parallel to the rotational axis, the pressures exerted on the tube cap increase appreciably.

The use of the tapered sealing plugs of this type, while quite satisfactory can cause a problem in that when the plug is pressed downward to seal a particular tube it acts somewhat like a piston. Any air that is above the liquid, if the tube is not completely filled, is compressed. Upon completion of the centrifuge run when the threaded disc or cap, which holds the plug in position, is removed the plug is forced upwardly by the compressed air. Simultaneously with this upward movement, droplets from the liquid within the tube often are expelled because of pressure of the compressed air. Normally this causes no problem. However, if the liquid is biologically dangerous or radioactive, the possibility exists that the rotor may be contaminated. Furthermore, in the centrifugation of light materials, such as lippo proteins, a portion of the sample itself may be lost.

The need exists, therefore, for a relatively easy to use, reliable cap or closure for centrifuge tubes in which the plug and tube are mechanically locked together and sealed against leakage. This permits the tube to be removed in toto from the rotor following centrifugation. The tube may be then placed on a lab bench prior to removing the plug from the tube such that contamination of the rotor is averted.

Another tube cap is described in U.S. Pat. No. 3,938,735 as having a plug portion with inwardly slanting shoulders. Grooves are formed on the shoulders to provide a more effective seal by causing the tube walls to cold flow into the grooves when the tube is sealed. Unfortunately, the plug described is somewhat difficult to remove and is not suitable for use with vertical tube rotors.

It is therefore an object of this invention to provide an improved seal for a centrifuge tube.

A further object of this invention is to provide an improved seal for vertically oriented centrifuge tubes.

In accordance with this invention, a centrifuge rotor for centrifuging a flexible sample container having an open end is constructed to have a rotational axis and a radially spaced, elongated enclosure cavity, with an open end and a longitudinal axis generally parallel to the rotational axis, adapted to receive the container. The open cavity end is flared. A first tapered plug and a retainer secured to the cavity end cooperate to wedge the walls of the open end of the container between the plug taper and the flare. The plug is formed with a peripheral groove in its tapered portion such that when the rotor is operated, the combined forces of the retainer and the hydrostatic forces of the fluid cause the sample container wall to cold flow into the groove forming a sealing and locking ring for the container. This has a particular advantage in that following centrifugation the tube may be removed from the rotor simply by lifting the plug. The plug may then be removed as desired, in some cases by simply depressing the walls of the tubes slightly to distort the ring and disengage it from the groove. The groove may be wedge-like in cross-section; alternatively, it may be round or rectangular in cross-section.

BRIEF DESCRIPTION OF THE DRAWINGS

Further advantages and features of this invention will become apparent upon consideration of the following description wherein.

DETAILED DESCRIPTION OF THE PREFERRED EMBODIMENT

While the apparatus of this invention may be used with any centrifuge rotor in which tubes are nested in rotor cavities, it is particularly useful with a vertical tube rotor. In a vertical tube rotor, the sample tubes or containers are generally vertically oriented for rotation about a vertical spin axis. Utilizing such vertical orientation has many advantages. Among these are short path lengths the particles must traverse during separation (the diameter of the tubes), and hence a relatively steep separation gradient during centrifugation, and a relatively long path length during recovery, i.e., there is a relatively wide separation of bands. Vertical tube rotors are described more fully in the said Romanauskas patent.

Figure 1:
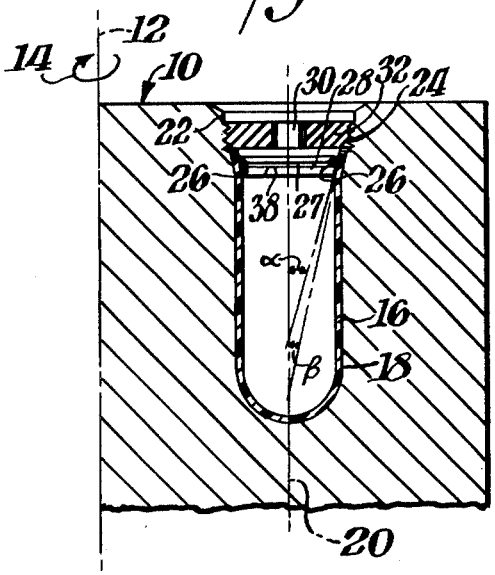
FIG. 1 is a fragmentary cross-section, elevation view of a centrifuge rotor, partly in schematic, showing a vertically oriented sample container, sealed utilizing a rotor seal constructed in accordance with one embodiment of this invention.

Such a vertically oriented rotor is depicted in FIG. 1 in which there is a fragmentary view of a rotor 10 adapted to be spun about a spin axis 12 in the clockwise sense depicted by the arrow 14. The rotor is adapted to hold a plurality (only one of which is shown) of circumferentially spaced sample tubes or containers 16. Each tube is adapted to be vertically inserted into a corresponding cavity 18, formed within the rotor 10, with a sliding fit. The cavity 18 preferably has a vertical axis 20 which is generally parallel to and, when the rotor rotates, the cavity spins aout the vertically oriented spin axis 12. The rotor is adapted to be driven by any suitable drive means such as a motor or other conventional prime mover (not shown). The tube 16, which may be elongated, is formed of any of the conventional resilient, flexible, or malleable materials that are used for centrifuge tubes. These materials include the polyallomers, cellulose nitrate, nylon and polypropylene. Any other suitably flexible material, having the characteristincs described hereinafter, may be used as well.

The top of the cavity 18 is formed with a counterbore 22 which is internally threaded as at 24. The shoulder formed between the counterbore 22 and the cavity 18, is located at a point corresponding to the lip of the tube 16. This shoulder or upper portion of the cavity 18, is slanted outwardly or flared as at 26 to accomodate a tapered plug 28. The plug may have a stem 30 to facilitate its removal following centrifugation. A retaining disc or cover 32 in the form of an annular ring or disc engages the threads 24 and loosely fits over the stem 30. The disc 32 is secured to the mouth of the rotor cavity 18 and urges the plug axially downward into the cavity 18 so as to wedge the thin flexible walls of the tube 16 between the taper of the plug and the shoulder flare 26. The resilience or flexibility of the walls of the tube 16 provides a fluid tight seal that is relatively secure and permits rotor speeds up to 65,000 revolutions per minute (rpm) and above without leakage. Lateral movement of the plug 28 within the limits permitted by the flexibility of the tube walls is permitted by the loose fit of the stem 30 in the cover 32.

The angle $\alpha$ of the taper of the plug, which may be defined as the angle formed between the projection of the periphery of the plug and the axis 20, may vary between 0° and an angle of less than 30°. The angle $\beta$ of the shoulder or flair 26 may vary between 1° and 30°—the angle $\beta$ of the shoulder being defined as the angle between the axis 20 and the projection of the flair on the axis. In a preferred embodiment of the invention, the angle $\beta$ of the flair is about 15° whereas the taper angle $\alpha$ is 2° more, or about 17°. Preferably, the taper angle $\alpha$ should be more than the flare angle $\beta$—this permits better cold flow of tube material—although the angles may be equal if desired. The problem encountered here with variation of the angles is that as the angles become too small, i.e., approach zero, the plug becomes more difficult to remove, whereas as the angles $\alpha$ and $\beta$ approach 30° or more, it requires more axial force in order to maintain the requisite wedging to provide an adequate seal.

Figure 4:
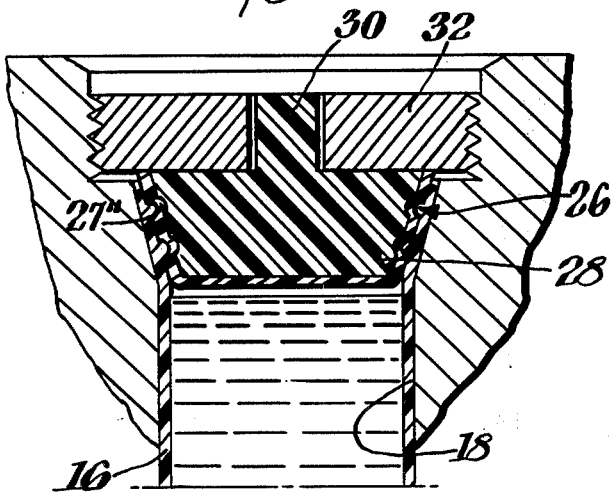
FIG. 4 is an enlarged fragmentary view of a rotor seal plug constructed in accordance with an alternative embodiment of this invention.

In accordance with this invention an annular peripheral groove 27 is formed in the annular tapered portion of the plug 28. Although this plug may be formed of a suitable rigid material such as aluminum or titanium, the same as the rotor with which it is used, preferably it is formed of an inert plastic material that will not react with or contaminate in any way the contents of the tube. It should be relatively rigid and not be as susceptible to cold flow under pressure as are the walls of the tube 16. It may be formed of any of the typical engineering plastics that are used for similar applications, such as acetal copolymer material, polycarbonate, polysulfone, phenylene oxide based resins, or as is depicted in FIG. 4, it may be a metal plug grooved in the same manner as described in FIGS. 1 and 2, but in this instance coated with a suitable plastic such as Teflon ® or other similar plastic suitable for coating metals.

In use the tube may be filled with the liquid that it is desired to centrifuge and placed within the cavity 18 of the rotor. The plug 28 is then placed in the open end of the tube and the fitted disc 32 is threaded into the rotor cavity 18. As the disc is tightened into position, the plug is forced downwardly thus entrapping a small layer of air 52 between the top of the liquid in the tube and the plug. As the plug is forced down causing the top of the tube to flare outwardly, this air 52 becomes compressed. During centrifugation the downward pressure exerted by the plug on the tube walls combined with the upward pressure caused by the hydrostatic pressure of the liquid, causes the tube walls, which are wedged between the flare of the cavity and the tube plug, to cold flow into the groove 26, thus forming a small lip or ring on the inside wall of the flared open end of the tube. This lip, designated 54, thus is a mechanical lock and seal between the plug and the tube.

Following centrifugation, the tube and plug as a unit may be removed from the rotor cavity simply by lifting the plug by the stem end 30. The tube may now be placed on any laboratory bench or suitable holder and the plug removed, if need be, by simply squeezing slightly the walls of the tube to deform the tube and cause the formed lip to be disengaged from the groove. This alleviates the prior problem of the tube plug being forced out of the tube because of the compressed air and avoids rotor contamination from this source. It also greatly facilitates the handling and removal of the tube following centrifugation.

Figure 2:
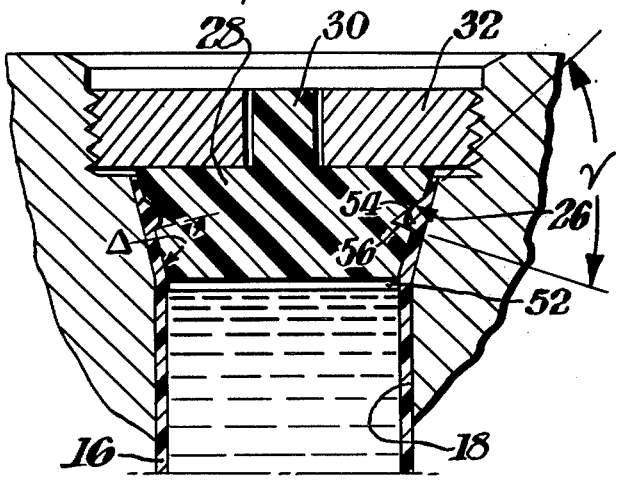
FIG. 2 is a fragmentary cross-sectional elevation view of the rotor seal depicted in FIG. 1, greatly enlarged, to illustrate some of the angles that are preferred in forming the plug and the grooves therein.

It may be seen most clearly in FIG. 2 that the grooves are illustrated, in a preferred embodiment of this invention, as having a V-shaped cross-section. Preferably, such grooves should be formed such that the lower edge 56 of the grooves (in the drawing) form an angle $\Delta$ of about 80° (measured clockwise) relative to the tapered periphery of the plug. This angle $\Delta$, however, may vary from a minimum of 30° up to a maximum of 130°. Similarly, the entrance angle of the groove itself $\gamma$ preferably is about 60° for a $\Delta$ angle of about 80°, but may vary anywhere from 30° up to a maximum that forms a groove in the taper of relatively small width, i.e., less than the thickness of the tube wall. The limits for the angles $\gamma$ and $\Delta$ may be exceeded slightly but as the limits are exceeded, the advantages of the invention decrease appreciably. The reason for the limits on the angle is that the corner formed by the lower edge should be sufficiently sharp to prevent the easy removal of the plug from the tube under normal conditions. If $\Delta$ is too large, the corner formed by the groove and the plug's taper is not sufficiently sharp to effectively grip the lip 54. On the other hand if Δ is too small, the corner may be too sharp to properly release the plug for removal. If the groove does not open sufficiently, the lip 54 will be too thin to provide the mechanical strength desired for an effective seal. The depth of the groove should be less than the thickness of the tube wall.

Figure 3:
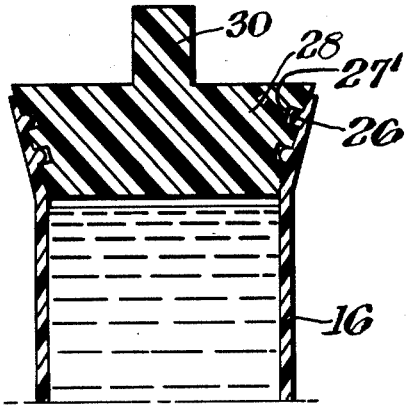
FIG. 3 is an enlarged elevation view of a seal plug utilizing plural grooves, having a rectangular cross-section, in accordance with an alternative embodiment of this invention.

In an alternative embodiment of the invention, as depicted in FIG. 3, plural grooves 27' are formed and are seen to have a rectangular cross-section. The limits on the lower edges of these grooves are the same as that described above. Also, it would be noted in the case of FIG. 3 that although two grooves are depicted, additional grooves may be added as desired, however, in most cases, two grooves are quite sufficient and are all that is required.

In still another embodiment of the invention, as has been previously noted, there is seen in FIG. 4 a grooved metal plug 28' that is coated with an inert plastic coating. Grooves 27'' are formed in this plug prior to coating. One or more grooves may be used. The coating may be of the same type as described above and must be sufficiently thin to accomodate the grooves. The grooves' lower edge angles for the grooves of FIGS. 3 and 4 are the same as defined in connection with FIGS. 1 and 2. Actually, grooves having a circular or parabolic cross section may be used, the critical characteristic being the angle Δ at which the lower edge of the groove intersects the angel of the plug taper.

There has thus been described a relatively simple effective seal for a centrifuge tube plug particularly of the type used with vertical tube rotors. This tube uses a plug with peripheral grooves such that the walls of the tube are caused to cold flow into the grooves forming a sealing lip that engages the grooves and thereby provides a good effective mechanical lock and seal for the plug. This permits the plug to be more effectively sealed and more easily removed from the centrifuge following centrifugation.

I claim:

1. In a centrifuge rotor for centrifuging a fluid sample in a flexible sample container subject to cold flow having an open end, said rotor having a rotational axis and a radially spaced cavity, with an open end and an axis through said open end generally parallel to said rotational axis, adapted to receive said container, said open cavity end being flared upwardly and outwardly, a first rigid plug tapered downwardly and inwardly, and a retainer secured to said open cavity end for wedging the walls of the open end of a sample container between said plug taper and said flare, the improvement of:

said plug having an annular groove about its periphery, whereby the combined forces of said retainer and, during operation of said rotor, hydrostatic forces of said fluid sample cause said sample container wall to cold flow into said groove forming a sealing and locking ring for said container that facilitates removal of said plug from the container with reduced disturbance of said fluid sample.

2. The centrifuge rotor of claim 1 wherein said groove is V-shaped in cross-section with the lower edge of said groove forming a corner which alone grips said locking ring to retain said plug.

3. The centrifuge rotor of claim 2 wherein said V-shaped cross section forms an angle of about 60° with the lower surface of said groove forming an angle of about 80° with said taper.

4. The centrifuge rotor of claim 3 wherein said plug is formed of an inert, rigid plastic less susceptible to cold flow than said flexible container.

5. The centrifuge rotor of claim 1 wherein said groove is rectangular in cross-section with the lower edge of said groove forming a corner which alone grips said locking ring to retain said plug.

6. The centrifuge rotor of claim 1 wherein said groove is circular in cross-section with the lower edge of said groove forming a corner which alone grips said locking ring to retain said plug.

7. The centrifuge rotor of claim 1 wherein said plug is formed of a rigid material and at least the tapered portions of said plug are coated with a flexible inert material, said groove being formed in said plug.

8. The centrifuge rotor set forth in claim 1 wherein said plug is formed of an inert, rigid plastic less susceptible to cold flow than said flexible container.

* * * * *